US007918425B2

(12) United States Patent
Rathbone et al.

(10) Patent No.: US 7,918,425 B2
(45) Date of Patent: Apr. 5, 2011

(54) UNIVERSAL ANTENNA MOUNT

(75) Inventors: Jason Rathbone, Amesbury, MA (US); Frank LaBarba, Newburyport, MA (US)

(73) Assignee: Raytheon Company, Waltham, MA (US)

( * ) Notice: Subject to any disclaimer, the term of this patent is extended or adjusted under 35 U.S.C. 154(b) by 346 days.

(21) Appl. No.: 12/148,905

(22) Filed: Apr. 23, 2008

(65) Prior Publication Data

US 2010/0025559 A1 Feb. 4, 2010

(51) Int. Cl.
*A47B 96/06* (2006.01)

(52) U.S. Cl. ..... 248/230.5; 248/228.1; 343/890

(58) Field of Classification Search ..... 248/230.3, 248/230.5, 231.61, 316.4, 219.4, 218.4, 534, 248/539, 540, 541; 343/892, 890, 878
See application file for complete search history.

(56) References Cited

U.S. PATENT DOCUMENTS

| | | | | |
|---|---|---|---|---|
| 2,899,764 | A * | 8/1959 | Oberlin | 40/604 |
| 3,018,081 | A * | 1/1962 | Waldbauer | 248/230.5 |
| 5,634,620 | A * | 6/1997 | Verot | 248/229.14 |
| 6,302,633 | B1 * | 10/2001 | Poe | 411/432 |
| 6,454,232 | B1 * | 9/2002 | Roth | 248/228.1 |

* cited by examiner

*Primary Examiner* — Gwendolyn Baxter

(74) *Attorney, Agent, or Firm* — Iandiorio Teska & Coleman

(57) ABSTRACT

A universal antenna mount featuring a first bracket with a concave face between right and left tangs, a reversible second bracket with a concave face and a generally convex opposite face between right and left tangs, and at least one fastener extending through the right tangs of the first and second brackets and at least one fastener extending through the left tangs of the first and second brackets.

10 Claims, 9 Drawing Sheets

UNIVERSAL ANTENNA MOUNT

GOVERNMENT RIGHTS

This invention was made with U.S. Government support under Contract No. W31P4Q-04-C-0020 by the U.S. Army. The Government has certain rights in the subject invention.

FIELD OF THE INVENTION

This subject invention relates to a more universal system for mounting antennas with different diameter poles to a mast.

BACKGROUND OF THE INVENTION

Modern mobile battle field electronic enclosures are reconfigurable to support, for example, different missions. Depending on the mission and the configuration of the electronic systems within the enclosure, different antennas may be used. In one example, the enclosure includes several extendable masts for various antennas. The antennas are mounted to a tripod or pole which can range in diameter from 1 to 4 inches.

Conventional U-shape brackets and/or the use of fasteners for securing the antennas to a mast cannot always accommodate the different diameter antenna poles. Also, in the battle field arena, one requirement is that the antennas be easily and quickly mounted to their respective mast and then quickly dismounted. Prior art antenna mounts which require the use of tools are problematic in such a situation.

SUMMARY OF THE INVENTION

It is therefore an object of this invention to provide a more universal antenna mount.

It is a further object of this invention to provide such an antenna mount which accommodates different diameter antenna poles whether round, square, or of some other shape.

It is a further object of this invention to provide such an antenna mount which is easy to assemble and disassemble.

It is a further object of this invention to provide such an antenna mount which does not require the use of any tools.

It is a further object of this invention to provide an adjustable fastener particularly useful in connection with the universal antenna mount of the subject invention.

The subject invention results from the realization in part that an antenna mount can be made more universal in design if at least one bracket in a pair of brackets is reversible and has one concave face and one generally convex face to accommodate a wide variety of different antenna pole diameters and shapes.

The subject invention, however, in other embodiments, need not achieve all these objectives and the claims hereof should not be limited to structures or methods capable of achieving these objectives.

The subject invention features a universal antenna mount comprising a first bracket with a concave face, a second reversible bracket with a concave face and an opposite generally convex face, and at least one fastener for urging the brackets together to secure a first diameter range of posts between the concave faces of the brackets and a second, smaller diameter range of posts between the concave face of the first bracket and the convex face of the second bracket.

In the preferred embodiment, the convex face of the second bracket includes a recess for gripping a post. Typically, each bracket includes a tang portion. There may be two space fasteners extending through each tang portion. One preferred fastener includes an adjustable length shank with at least two slots. Then, one said bracket includes a pin receivable in the slots.

One universal antenna mount in accordance with the subject invention includes a first bracket with a concave face between right and left tangs and a reversible second bracket with a concave face and a generally convex opposite face between right and left tangs. At least one fastener extends through the right tangs of the first and second brackets and at least one fastener extends through the left tangs of the first and second brackets. The preferred fastener includes an adjustable length shank with at least two spaced slots. Then, one of the tangs includes an orifice for the adjustable length shank and a pin traversing the orifice.

Further included are brackets for securing one said tang to a mast. One bracket is a straight plate; another bracket is an angled plate.

The subject invention also features an adjustable length fastener system comprising a shaft including at least two spaced slots and a threaded portion. A nut is threadable on the threaded portion. The shaft is received through an orifice with a pin traversing the orifice receivable in one slot in the shaft.

One antenna mounting system in accordance with this invention includes a mast with one or more universal antenna mounts thereon. Each antenna mount includes a first bracket with a concave face, a second reversible bracket with a concave face and an opposite generally convex face, and at least one fastener for urging the brackets together to secure a first diameter range of posts between the concave faces of the brackets and a second, smaller diameter range of posts between the concave face of the first bracket and the convex face of the second bracket.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
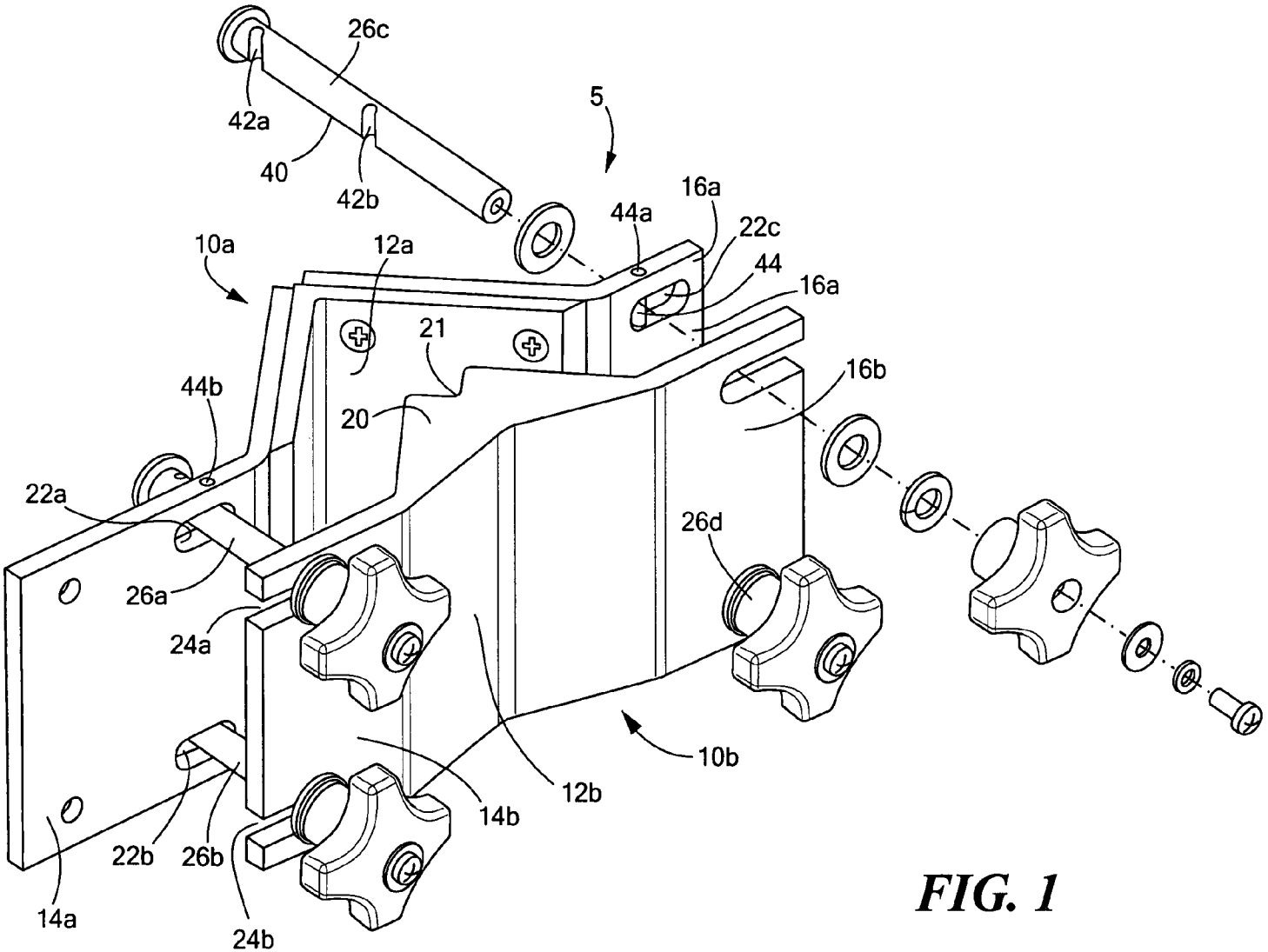
FIG. 1 is a schematic three-dimensional front view of an example of a universal antenna mount in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 depicts an example of a universal antenna mount in accordance with the subject invention. Bracket 10*a* includes concave face 12*a* between left tang 14*a* and right tang 16*a*. Reversible bracket 10*a* includes concave face 12*b* between left tang 14*b* and right tang 16*b* and opposite generally convex face 20 with recess 21. To urge the two brackets together, left tang 14*a* of bracket 10*a* includes orifices 22*a* and 22*b* and left tang 14*b* of bracket 10*b* includes recesses 24*a* and 24*b*. Fasteners 26*a* and 26*b* extend, respectively, through orifice 22*a* and recess 24*a* and through orifice 22*b* and recess 24*b*. Right tangs 16*a* and 16*b* include a similar construction to accept fasteners 26*c* and 26*d* as shown.

Figure 2:
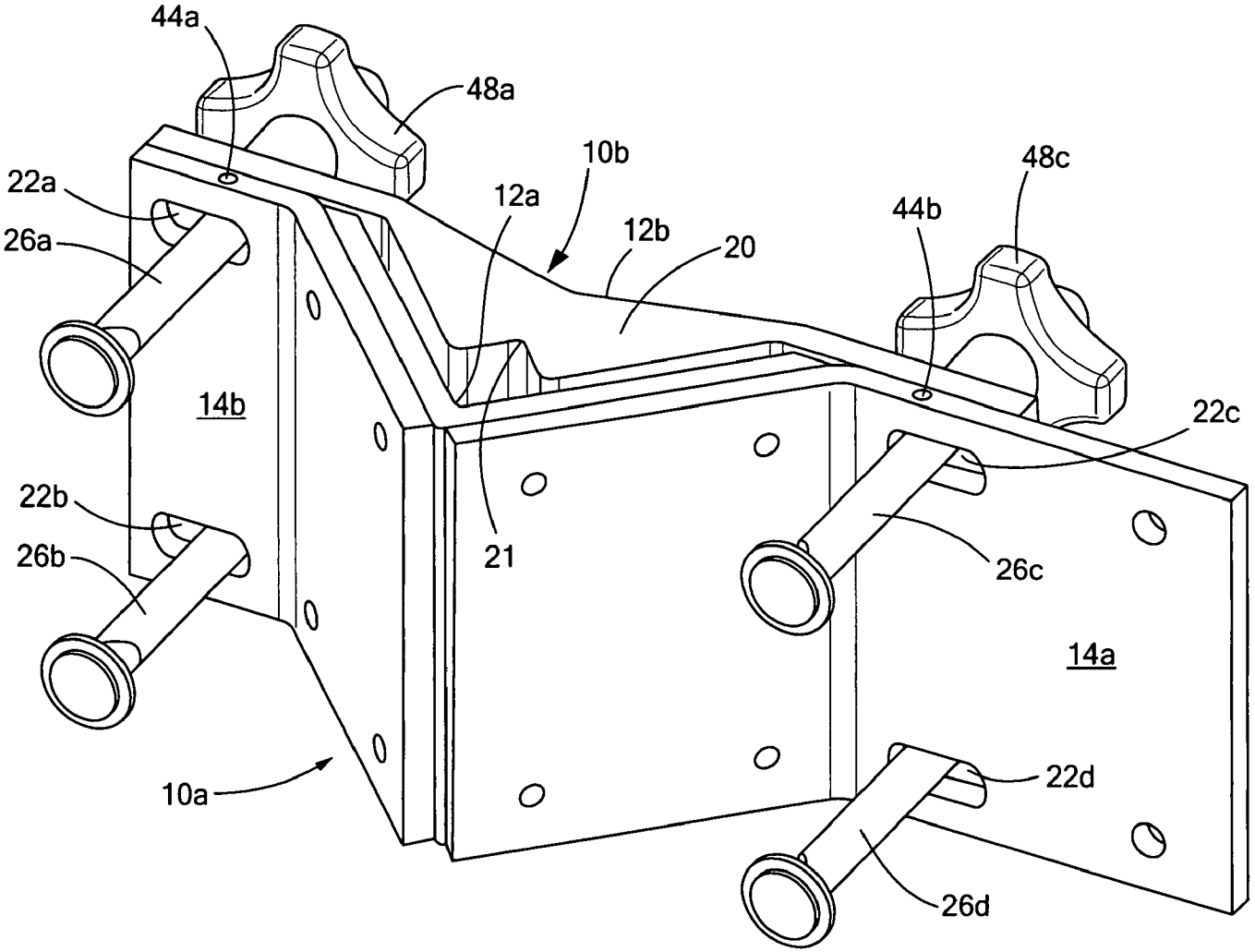
FIG. 2 is another schematic three-dimensional view of the antenna mount of FIG. 1.

In one preferred embodiment, each fastener, as shown for fastener 26*c*, includes adjustable length shaft 40 with spaced slots 42*a* and 42*b*. Pin 44 traverses orifice 22*c* and thus locks slot 44*a* or 42*b* in place with respect to tang 16*a*. FIG. 2 shows all the fasteners 26*a*-26*d* adjusted so their respective nuts 48*a*-48*d* do not need to be threaded along the vast majority of the shank of each fastener in order to urge bracket 10*a* in proximity to bracket 10*b* around an antenna pole. This feature allows quick coupling of a small diameter antenna pole between brackets 10*a* and 10*b*.

Figure 3:
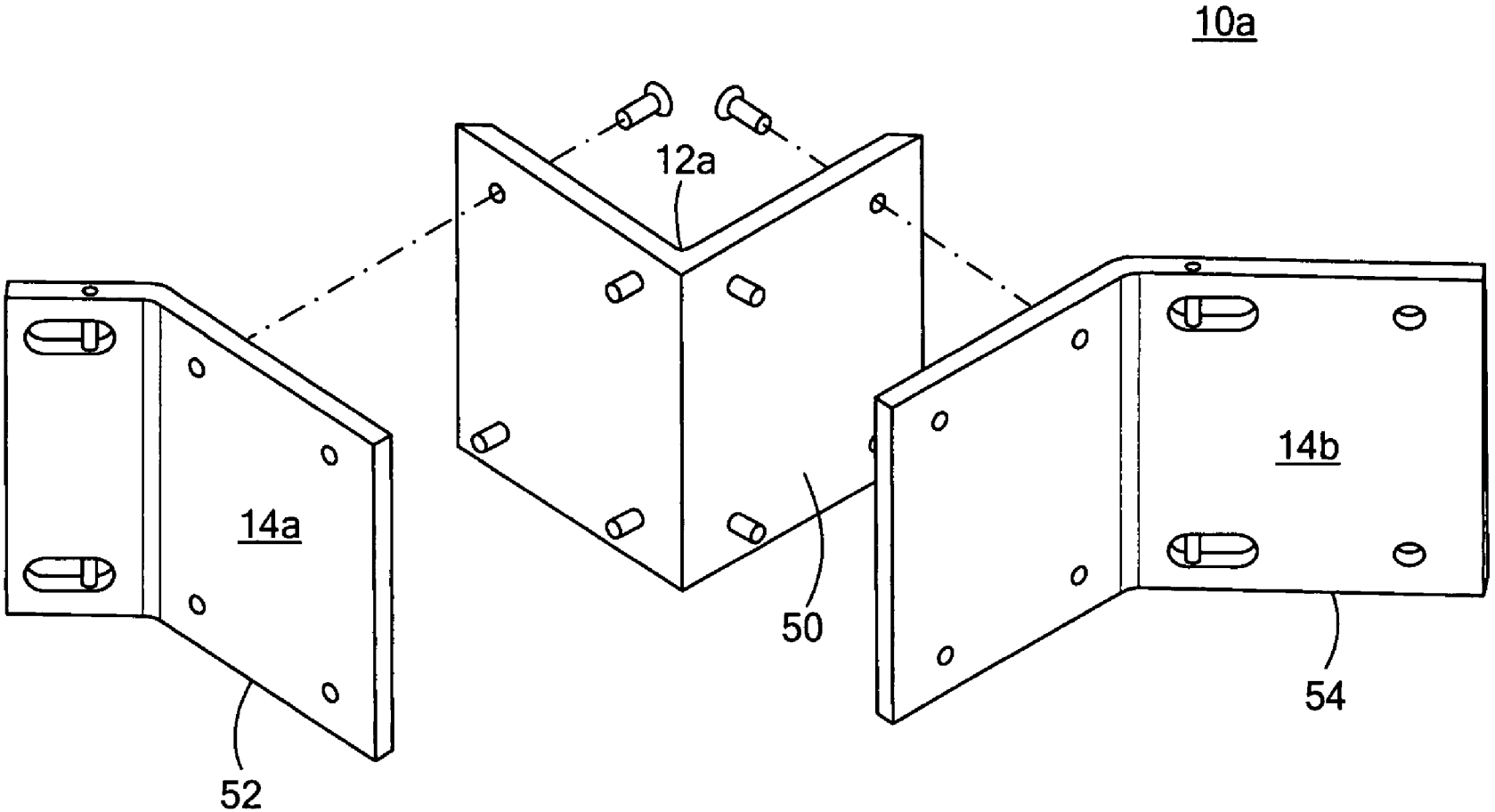
FIG. 3 is a schematic three-dimensional exploded view showing the primary components associated with one bracket of the antenna mount shown in FIGS. 1 and 2.

FIG. 3 shows one construction of bracket 10*a* wherein convex face 12*a* is formed via right angle bracket 50 and tangs 14*a* and 14*b* are formed by angled brackets 52 and 54, respectively.

Figure 4:
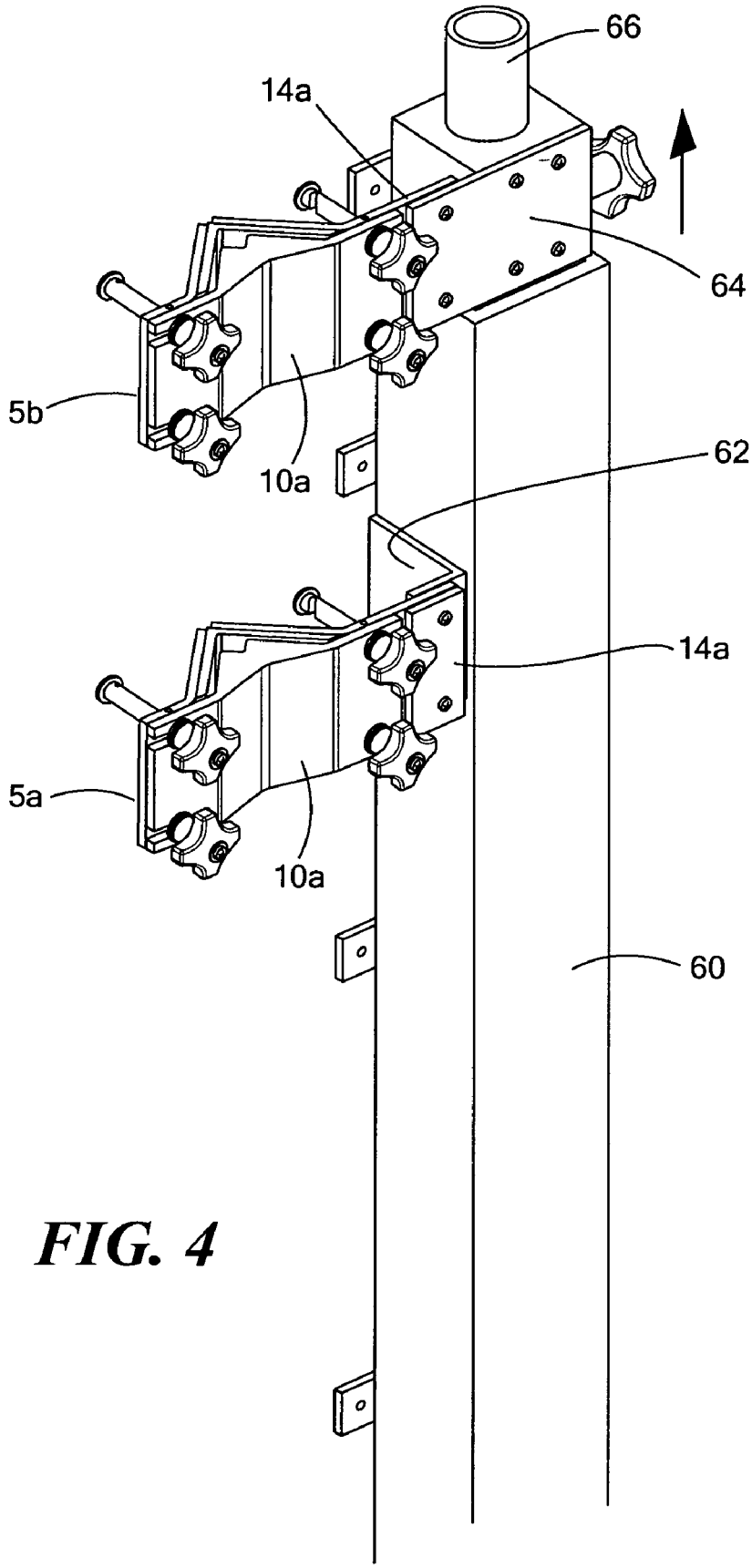
FIG. 4 is a highly schematic three-dimensional view showing two antenna mounts in accordance with the subject invention mounted to an extendable mast.
Figure 5:
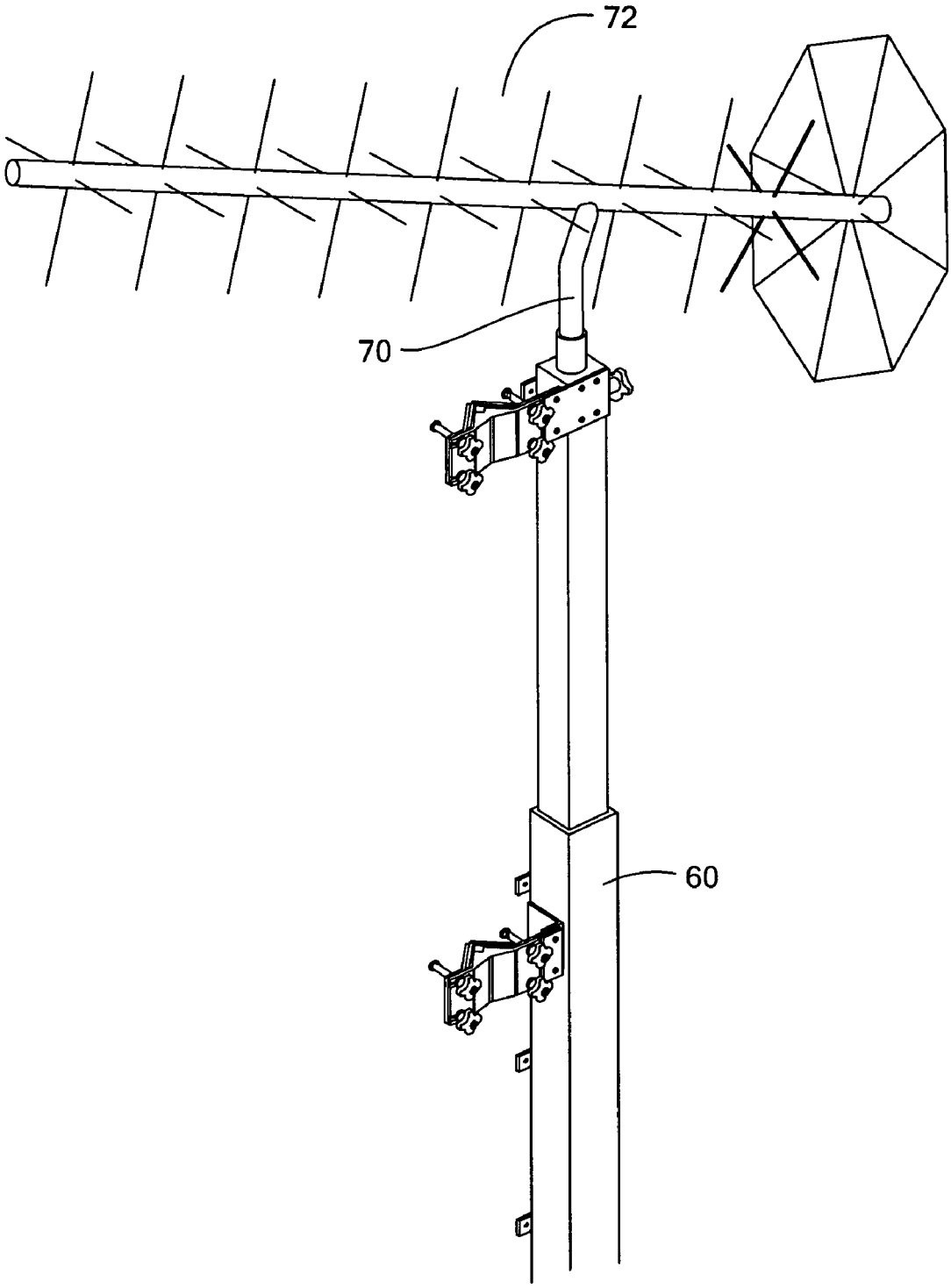
FIG. 5 is a highly schematic three-dimensional view showing two antenna mounts in accordance with the subject invention mounted to an extendable mast and also showing an interface on the mast for another type of antenna.

FIG. 4 shows two universal antenna mounts 5*a* and 5*b* on mast 60. Right angle bracket 62 attaches to mast 60 and tang 14*a* of bracket 10*a* to secure antenna mount 5*a* to mast 60 and straight bracket 64 attaches to mast 60 and tang 14*a* of bracket 10*a* to secure antenna mount 5*b* to mast 60. Mast 60 also includes interface 66 adapted to receive, in this example, the post 70 of SATCOM antenna 72, FIG. 5 once it is removed from its tripod. FIG. 5 also shows mast 60 in its extended position.

Figure 6A:
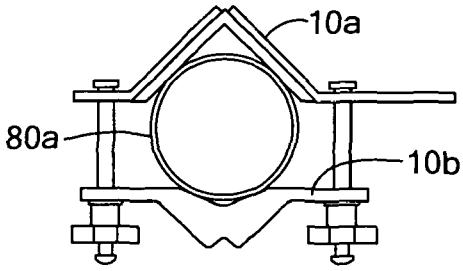
FIGS. 6A-6G are schematic top views showing how the universal antenna mount of the subject invention accommodates different diameter antenna poles.
Figure 6B:
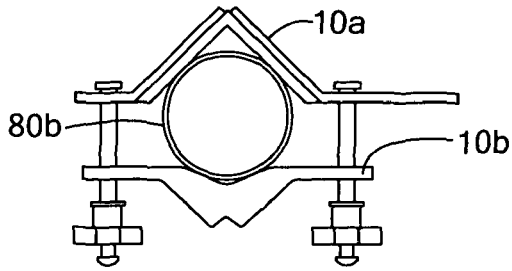
Figure 6C:
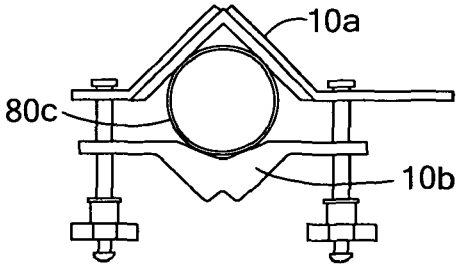
Figure 6D:
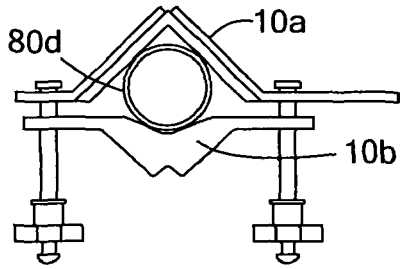
Figure 6E:
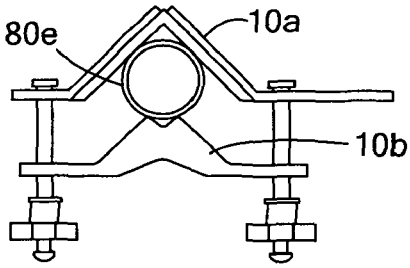
Figure 6F:
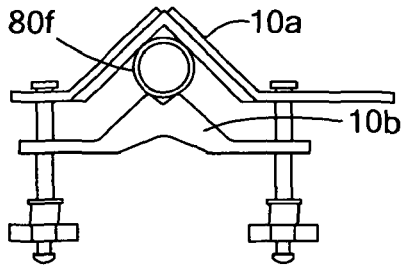
Figure 6G:
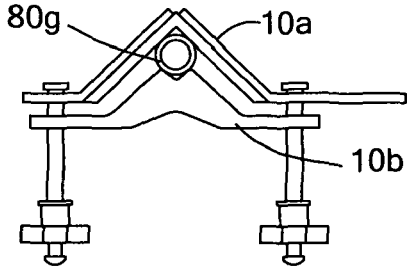

FIGS. 6A-6G show how universal antenna mount 5 can accommodate a wide variety of antenna pole diameters. In FIGS. 6A-6D, bracket 10*b* is oriented so its concave face side clamps, with the concave face of bracket 10*a*, antenna poles 80*a*-80*d* ranging in diameter from 4 to 2.5 inches. Then, by reversing bracket 10*b*, as shown in FIGS. 6E-6G, the convex face thereof can be used to secure, with bracket 10*a*, antenna poles 80*e*-80*g* ranging in diameter from 2 inches to 1 inch. Antenna poles of different shapes can similarly be accommodated by the mount of the subject invention.

Figure 7:
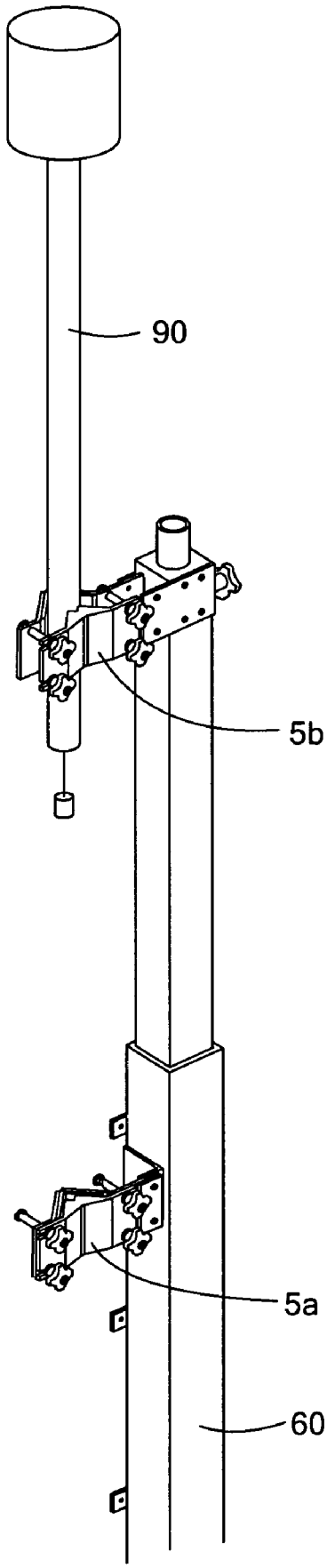
FIG. 7 is a schematic three-dimensional view showing one type of antenna mounted to a universal antenna mount in accordance with the subject invention.
Figure 8:
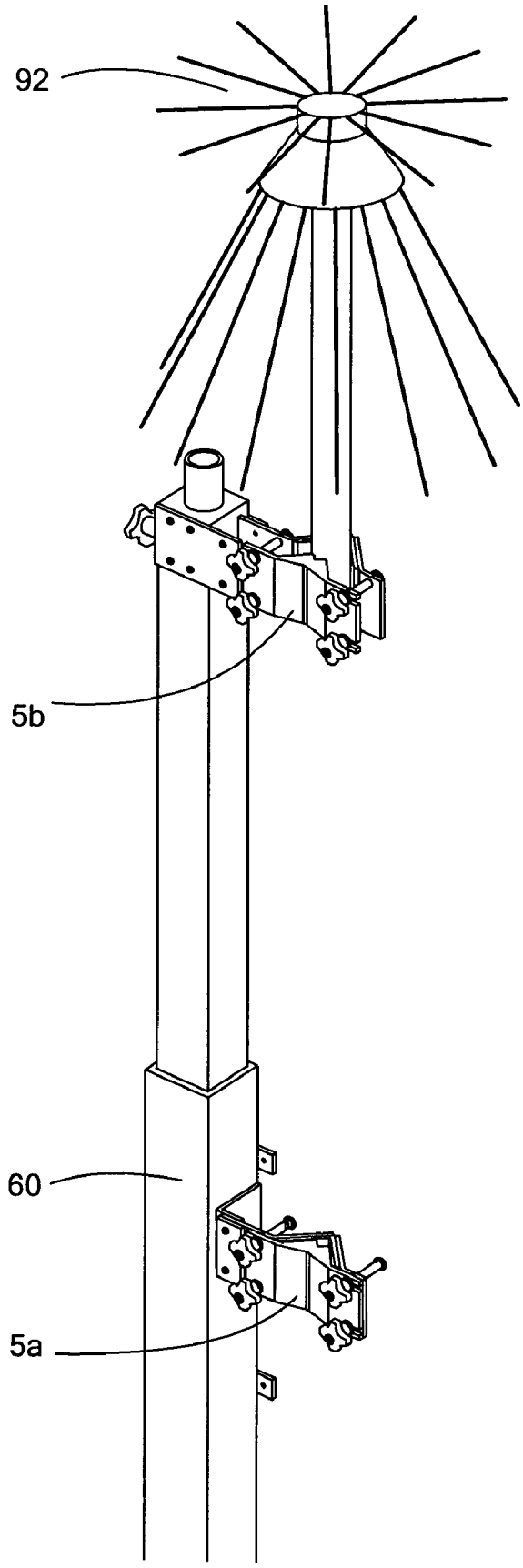
FIG. 8 is a highly schematic three-dimensional view showing another type of antenna mounted to the same universal antenna mount.
Figure 9:
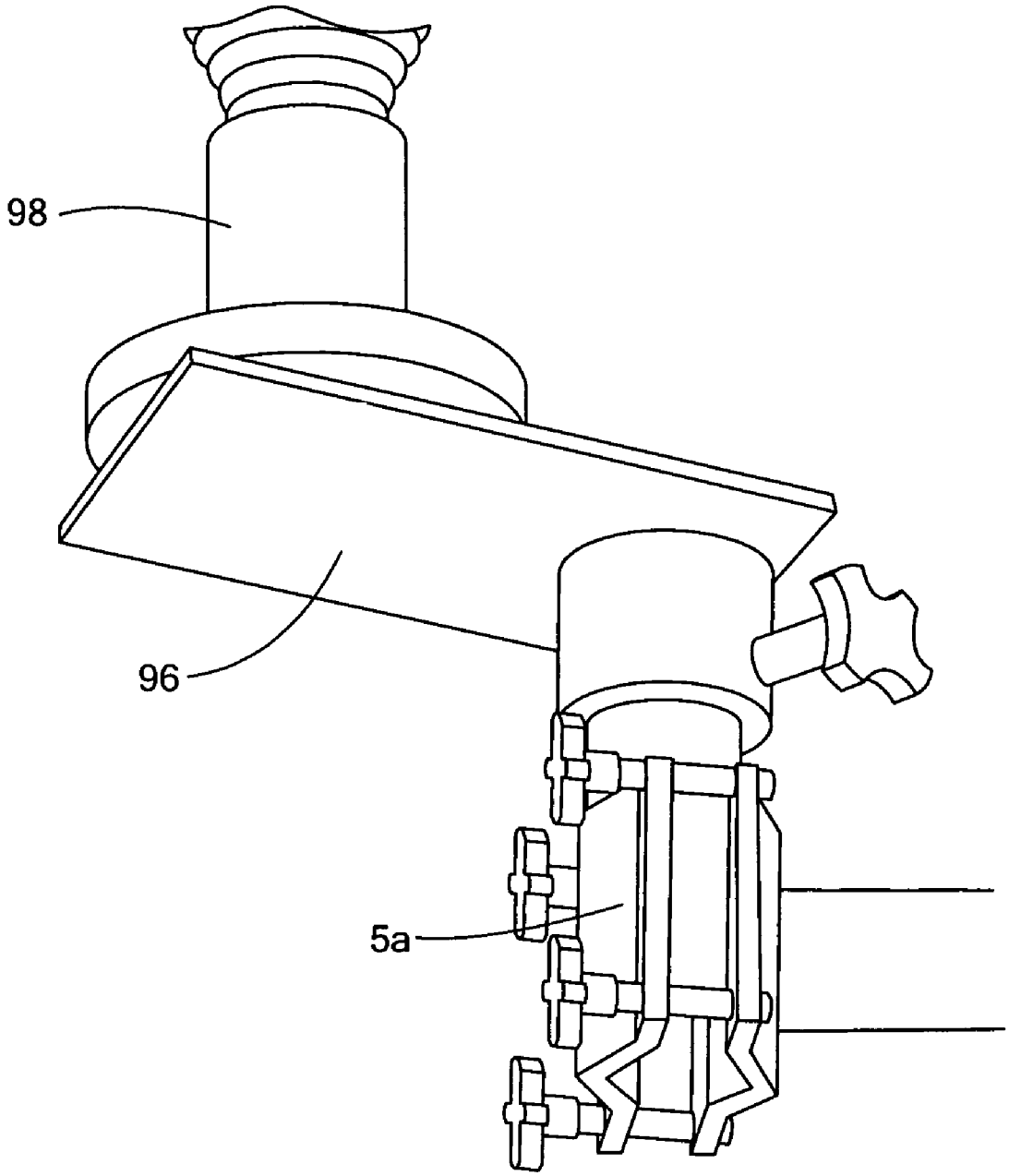
FIG. 9 is a schematic three-dimensional view showing how the universal antenna mount of the subject invention can accommodate an adaptor useful for mounting different types of antennas.

FIG. 7 shows mount 5*b* with ANT400K antenna 90 and FIG. 8 shows mount 5*b* with AT-197 antenna 92. FIG. 9 shows mount 5*a* with adaptor 96 clamped therein for SINCGARS (or EPLRS) antenna 98.

The result, in any embodiment is a more universal antenna mount which accommodates different diameter and shape antenna poles. The antenna mount is easy to assemble and disassemble and in the preferred embodiment does not require to use of any tools.

The subject invention also features an adjustable fastener as disclosed herein which is particularly useful in connection with the universal antenna mount of the subject invention but may have uses apart from the universal antenna mount.

The preferred universal antenna mount of the subject invention is particularly well suited for use with height reducible electronics enclosures. The invention could be implemented, however, on any tactical electronics enclosure where antennas are used and also has a broad commercial application where mounting a broad range of different diameter or shapes of antenna pole are required. But, subject mount is not limited to antennas and has applicability to secure tubes or masts or the like of varying sizes and shapes whether circular, square, or some other shape. The broad diameter range (in the example disclosed herein, 1 inch to 4 inches) allows the mount to accept multiple antenna types including, but not limited to, ACUS dish, ANT400K, AV2011, DM-SE109, MIDS, and JTIDS antennas. The mount also provides an option for personnel to place what are typically ground-mount tripods on the roof of shelters which minimizes trip hazards. Conveniently, no tools are required to emplace or swap antenna types.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A universal antenna mount comprising:

a first bracket with a concave face;

a second reversible bracket with a concave face and an opposite generally convex face;

at least one fastener for urging the brackets together to secure a first diameter range of posts between the concave faces of the brackets and a second, smaller diameter range of posts between the concave face of the first bracket and the convex face of the second bracket; and the fastener including an adjustable length shank with at least two slots and one said bracket includes a pin receivable in the slots.

2. The universal antenna mount of claim 1 in which the convex face of the second bracket includes a recess for gripping a post.

3. The universal antenna mount of claim 1 in which each bracket includes a tang portion.

4. The universal antenna mount of claim 3 in which there are two spaced fasteners extending through each tang portion.

5. A universal antenna mount comprising:

a first bracket with a concave face between right and left tangs;

a reversible second bracket with a concave face and a generally convex opposite face between right and left tangs;

at least one fastener extending through the right tangs of the first and second brackets and at least one fastener extending through the left tangs of the first and second brackets, a fastener including an adjustable length shank with at least two spaced slots and at least one of said tangs including an orifice for the adjustable length shank and a pin traversing the orifice receivable in a slot in the shank.

6. The antenna mount of claim 5 further including a bracket for securing one said tang to a mast.

7. The antenna mount of claim 6 in which said bracket is a straight plate.

8. The antenna mount of claim 6 in which said bracket is an angled plate.

9. An antenna mounting system comprising:

a mast including one or more universal antenna mounts thereon, each antenna mount comprising:

a first bracket with a concave face, a second reversible bracket with a concave face and an opposite generally convex face, and at least one fastener for urging the brackets together to secure a first diameter range of posts between the concave faces of the brackets and a second, smaller diameter range of posts between the concave face of the first bracket and the convex face of the second bracket, each bracket including at least one tang portion;

two spaced fasteners extending through each tang portion, a fastener including an adjustable length shank with at least two slots, one said bracket tang portion including a pin receivable in a slot.

10. The system of claim 9 in which the convex face of the second bracket includes a recess for gripping a post.

* * * * *